US011187045B2

(12) United States Patent
Ries et al.

(10) Patent No.: US 11,187,045 B2
(45) Date of Patent: Nov. 30, 2021

(54) DRILL BIT WITH WEAR SHIELD

(71) Applicant: ELEMENT SIX GMBH, BURGHAUN (DE)

(72) Inventors: Bernd Heinrich Ries, Burghaun (DE); Hauke Hinners, Burghaun (DE); Ian Grenbjörk, Avesta (SE); Tomas Rostvall, Stockholm (SE)

(73) Assignee: ELEMENT SIX GMBH, Burghaun (DE)

( * ) Notice: Subject to any disclaimer, the term of this patent is extended or adjusted under 35 U.S.C. 154(b) by 0 days.

(21) Appl. No.: 16/757,734

(22) PCT Filed: Jan. 3, 2019

(86) PCT No.: PCT/EP2019/050080
§ 371 (c)(1),
(2) Date: Apr. 20, 2020

(87) PCT Pub. No.: WO2019/134929
PCT Pub. Date: Jul. 11, 2019

(65) Prior Publication Data

US 2021/0189804 A1 Jun. 24, 2021

(30) Foreign Application Priority Data

Jan. 8, 2018 (GB) ..... 1800250

(51) Int. Cl.
*E21B 10/38* (2006.01)
*E21B 10/56* (2006.01)

(52) U.S. Cl.
CPC ..... *E21B 10/38* (2013.01); *E21B 10/56* (2013.01)

(58) Field of Classification Search
CPC ..... E21B 10/36; E21B 10/38; E21B 10/40; E21B 10/46; E21B 10/60; E21B 10/56; E21B 17/1085; E21B 12/04
See application file for complete search history.

(56) References Cited

U.S. PATENT DOCUMENTS 3,548,959 A 12/1970 Hasiba
4,884,477 A * 12/1989 Smith ..... B22F 7/06 76/108.2
5,025,875 A 6/1991 Witt
5,111,892 A * 5/1992 Sinor ..... E21B 10/43 175/371

(Continued)

FOREIGN PATENT DOCUMENTS

GB 2081347 A 2/1982
GB 2467439 A 8/2010

(Continued)

OTHER PUBLICATIONS

United Kingdom Patent Application No. GB1800250.1, Combined Search and Examination Report dated May 29, 2018, 7 pages.

(Continued)

*Primary Examiner* — Blake Michener
(74) *Attorney, Agent, or Firm* — Dean W. Russell; Clark F. Weight; Kilpatrick Townsend & Stockton LLP

(57) ABSTRACT

This disclosure relates to a percussive drill bit comprising PCD studs and a hard facing material that is strategically located to minimise stud pop outs and the amount of hard facing material used.

11 Claims, 2 Drawing Sheets

(56) References Cited

U.S. PATENT DOCUMENTS 6,234,261 B1 * 5/2001 Evans ..... E21B 10/46 156/154
7,237,628 B2 * 7/2007 Desai ..... E21B 10/55 175/406
9,085,703 B2 * 7/2015 King ..... C09D 7/61
10,190,369 B2 * 1/2019 Olsen ..... B22F 7/08
2007/0039761 A1 * 2/2007 Cruz ..... E21B 10/36 175/415
2007/0107942 A1 * 5/2007 Overstreet ..... E21B 10/46 175/57
2008/0087473 A1 4/2008 Hall et al.
2010/0101866 A1 * 4/2010 Bird ..... C22C 29/08 175/374
2010/0193253 A1 * 8/2010 Massey ..... E21B 17/1085 175/393
2011/0000715 A1 * 1/2011 Lyons ..... E21B 10/46 175/374
2011/0174548 A1 * 7/2011 Patel ..... B23P 6/00 175/425
2012/0205162 A1 * 8/2012 Patel ..... B23P 6/00 175/426
2013/0092453 A1 * 4/2013 Johnson ..... C22C 29/08 175/428
2013/0152736 A1 * 6/2013 Lyons ..... B23K 35/36 75/302
2013/0247475 A1 9/2013 Lind et al.
2015/0122552 A1 * 5/2015 Wang ..... C04B 35/6268 175/428
2015/0184463 A1 * 7/2015 Patel ..... E21B 10/46 29/402.11
2015/0368980 A1 12/2015 Cook, III et al.
2015/0376954 A1 * 12/2015 Patel ..... E21B 17/1085 76/108.4
2016/0017667 A1 * 1/2016 Lyons ..... C22C 26/00 175/428
2017/0101825 A1 4/2017 Olsen et al.
2018/0340375 A1 * 11/2018 Schroder ..... E21B 10/50
2020/0024902 A1 * 1/2020 Daniels ..... E21B 10/36

FOREIGN PATENT DOCUMENTS

JP 07038293 U 7/1995
JP 2013136937 A 7/2013
RU 2537728 C1 1/2015
WO 2010088233 A2 8/2010
WO 2016171711 A1 10/2016

OTHER PUBLICATIONS

United Kingdom Patent Application No. GB1900053.8, Search Report dated Mar. 22, 2019, 5 pages.
International Patent Application No. PCT/EP2019/050080, International Search Report and Written Opinion dated Apr. 2, 2019, 12 pages.

* cited by examiner

DRILL BIT WITH WEAR SHIELD

TECHNICAL FIELD

The present disclosure relates to a drill bit for use in mining, oil and gas, and construction operations. It relates particularly but not exclusively to a down-the-hole (DTH) drill bit or a top hammer (TH) drill bit, which are specific types of drill bit used with a primarily percussive action.

BACKGROUND OF THE DISCLOSURE

Percussive drilling is used for drilling holes in a wide variety of rock types. Percussive drilling is used in, for example, the oil and gas industry to produce deep well bore holes. It is also used in the construction industry to produce pilings and footings. Percussive drilling is also used in mining operations, to drill holes filled with explosives which are subsequently detonated to allow access to ore within rock formations.

A percussive hammer and drill bit is one of the fastest ways of drilling rock. The hammer resembles a small jack hammer. It is air-powered with a high cyclic rate, and combines its fast action hammer with a rotary drilling action. This combined action rotates its chisel-like tip as it drives into rock formation, breaking it into chips and dust. Because the hammer is pneumatically powered, it has an air exhaust which blows the chips and dust from the bore.

The drill bit is mounted on the lower end of a drill string. The hammer, also known as the percussion mechanism, is located directly behind the drill bit in the case of DTH percussive drilling or above ground for TH percussive drilling. Drill pipes connected to the drill string serve to deliver the necessary feed force and rotation to the hammer and bit, along with compressed air. As the hole gets deeper, additional drill pipes are added successively.

Percussive drill bits are subject to extreme operational conditions, and like any other piece of equipment suffer from wear and tear. Once a drill bit becomes too worn to drill at an adequate rate or make a full-gauge hole, operations must be halted to replace the bit.

A worn prior art percussive drill bit is shown in FIG. 1, indicated generally at 10. Button inserts 12 made of wear resistant cemented carbide have been provided on the bit impact face 14 in a bid to extend the operational life of the drill bit 10. However, the steel body 16 of the drill bit has worn away prematurely compared to the button inserts 12, and two of the button inserts 12 have been lost through a fault commonly known as 'button pop-out'. The seats of the two lost button inserts are indicated at 18. The advantages of the button inserts 12 have not therefore been fully realised.

It is an object of the invention to provide a drill bit with optimised penetration rate and extended operational life.

SUMMARY OF THE DISCLOSURE

According to the invention, there is provided a drill bit comprising a drill bit body with an impact face, the drill bit body having a longitudinal axis of rotation, an internal conduit for supplying pressurised fluid to the impact face, at least one exhaust port in the impact face and in fluid communication with the internal conduit, and a wear shield adjacent to each exhaust port, wherein the wear shield is located only on a trailing side of each exhaust port, defined with respect to the direction of rotation.

The wear shield provides targeted protection against 'body wash', which is commonly known to be the gradual wearing away of the drill bit body over time. The wear shield is situated in the location on the impact face most susceptible to wear. As exhaust air from the hammer operation exits the exhaust port during operation, it flushes rock formation chips and dust across the impact face. As the drill bit rotates, the rock cuttings flow in the opposite direction to the direction of rotation of the drill bit. As such, body wash of the drill bit body is thought to originate just 'behind' (in terms of direction of the drill bit rotation) and adjacent to the exhaust ports. By specifically targeting this zone (or zones, as there will be several distinct zones depending on the quantity of exhaust ports), the enhanced wear protection is only provided where it is most necessary, thereby reducing the cost of additional wear resistant materials. Body wash may still develop in time but elsewhere on the impact face, and later (after more drilling) than it would have done without the wear shield.

Preferable and/or optional features of the invention are provided in claims 2 to 14 inclusively.

BRIEF DESCRIPTION OF THE DRAWINGS

A more complete and thorough understanding of the present embodiment and advantages thereof may be acquired by referring to the following description taken in conjunction with the accompanying drawings, in which like reference numbers indicate like features, and wherein.

DETAILED DESCRIPTION

Figure 1:
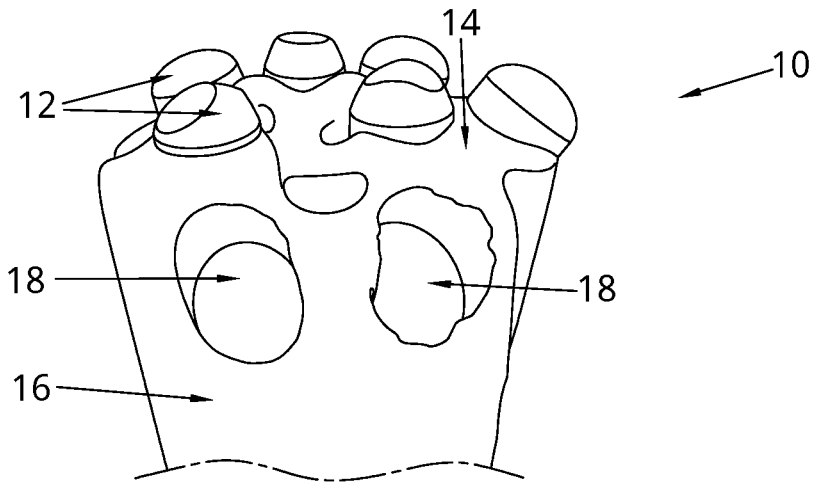
FIG. 1 is a worn prior art drill bit.
Figure 2:
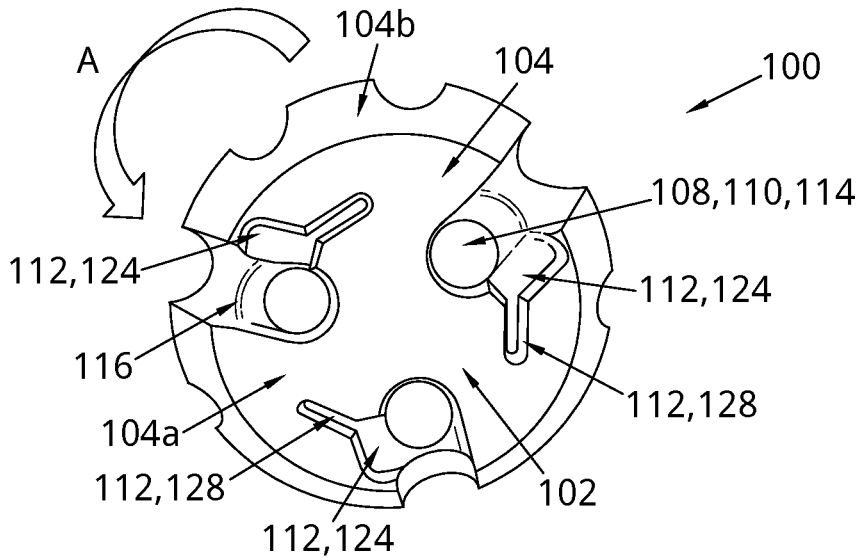
FIG. 2 is top plan view of a drill bit according to the invention, in a partially assembled state.
Figure 3:
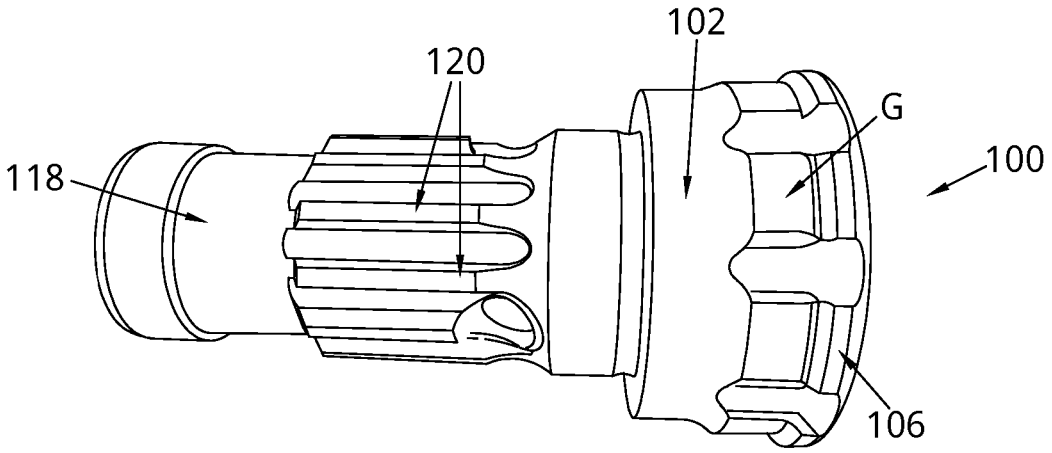
FIG. 3 is a side view of the drill bit of FIG. 2.
Figure 4:
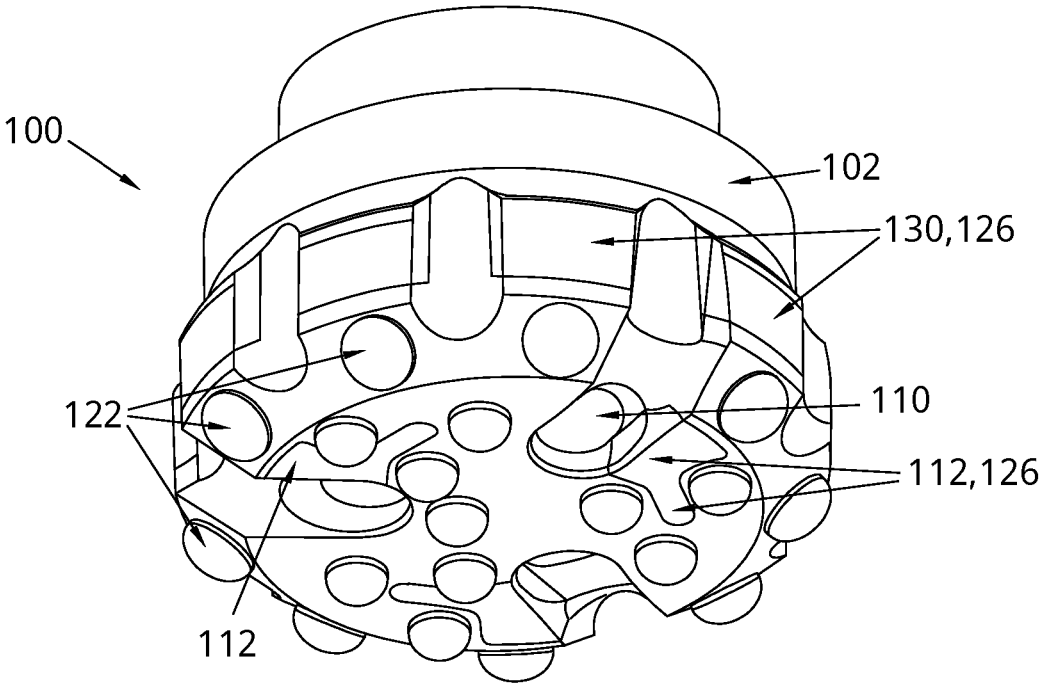
FIG. 4 is a schematic perspective view of the of the drill bit according to the invention, in a fully assembled state.

Referring to FIGS. 2, 3 and 4, a drill bit in accordance with the invention is indicated generally at 100. The drill bit 100 is connectable to a percussion mechanism and drill string in a conventional manner. It is the drill bit 100 that is the focus of this invention.

The drill bit 100 comprises a drill bit body 102 having an impact face 104 and a gauge wall 106 extending from the impact face 104 for setting the desired diameter of the bore hole. The drill bit 100 also comprises an internal conduit 108 for supplying pressurised air to the impact face 104, three exhaust ports 110 in the impact face 104 and in fluid communication with the internal conduit 108, and a wear shield 112 provided exclusively adjacent to each exhaust port 110.

The term 'exclusive' is intended to differentiate this invention from drill bits with hard facings which may cover the entire impact face, or a significant proportion of it. The specific location of the wear shield 112 relative to the or each exhaust port 110 is important.

In this embodiment, the impact face 104 is planar (i.e. flat or substantially flat). In particular, the impact face 104 comprises two planar face portions, these being a primary face portion 104*a* and a secondary face portion 104*b*. The primary face portion 104*a* extends in a plane that is perpendicular to the axis of rotation of the drill bit body 102, whereas the secondary face portion 104*b* depends from a peripheral extent of the primary face portion 104*a* at an angle such that it slopes radially outwardly and away from the primary face portion 104*a*.

The impact face 104 may alternatively be curved. If curved, it may be concave or convex. Concave faces are generally considered to excellent all-round performers, used as a general purpose bit for most conditions while drilling a very straight hole. Convex faces are used for a combination of speed and service life. Flat faces are best suited for broken or fragmented ground and hard formations.

Each exhaust port 110 comprises a through-hole 114 joined at one end to the internal conduit 108 and at the other end, to a generally elongate flush groove 116. The flush groove 116 extends radially away from the through-hole 112. The flush groove 116 extends from a position, which is almost central on the primary face portion 104*a*, through to the peripheral extent of the secondary face portion 104*b*. Any quantity of exhaust ports 110 may be provided rather than the aforementioned three, for example, 2, 3, 4, 5 or 6.

Additionally, the drill bit 100 comprises a shank 118 including a plurality of splines 120 for connecting to a hammer (not shown), and a plurality of button inserts 122 in the impact face 104.

The shank 118 adjoins the drill bit body 102. The drill bit body 102 and shank 118 conventionally comprise steel or an alloy thereof. Both drill bit body 102 and shank 118 are typically cylindrical. The outer diameter of the gauge wall 106 may be around 140 mm but any size diameter may be used as required by the drilling operation. The outer diameter of the shank 118 is less than that of the gauge wall 106 to allow for maneuverability of the drill bit 100. The drill bit body 102 has a longitudinal axis of rotation (best seen in FIG. 3) and the wear shield 112 is located in the impact face 104, after each exhaust port 110 in the direction of rotation (indicated by arrow A in FIG. 2). In other words, the wear shield 112 is located on a trailing edge of the exhaust port 110.

The wear shield 112 comprises a recess 124 in the impact face 104 filled with a hard facing element 126. The hard facing element 126 is a filler material that is significantly more wear resistant than the bulk material of the drill bit body 102. The hard facing element 126 preferably comprises a low melting point carbide (LMC) material, characterised by its iron base. Exemplary materials are described in U.S. Pat. Nos. 8,968,834, 8,846,207 and 8,753,755. Alternatively, the hard facing element 126 may comprise cemented carbide or polycrystalline diamond (PCD) material, or other wear resistant material.

The recess 124 is elongate and extends alongside the exhaust port 110. The wear shield 112 adjoins the flush groove 114. Specifically, the recess 124 is open on one side to the flush groove 114. More particularly, the recess 124 is generally rectangular and has filleted internal corners. Although the exact dimensions of the recess 124 will depend on the size of the drill bit, typically, the recess 124 has a depth into the impact face of around 5 mm.

The wear shield 112 further comprises a second recess 128 in the impact face 104 also filled with hard facing element 126. The purpose of the second recess 128, when filled with hard facing element 126, is to limit the progress of wear scars, which are thought to originate in the zone of excessive wear adjacent to the exhaust port 110.

The second recess 128 adjoins the first mentioned recess 124. The second recess 128 extends generally circumferentially away from the first recess 124. The second recess 128 is also elongate and is connected to the first recess 124 proximate the through-hole 112 of the exhaust port 110. The second recess 128 is rotationally behind the first recess 124 in the direction of rotation of the drill bit.

As a set, the exhaust port 110 including through-hole 112 and flush groove 116, and wear shield 112 including first and second recesses, are spaced apart on the impact face from two further sets of the same. As an option, the drill bit 100 may comprise two, four or five sets of the same.

As an option, the wear shield 112 may be applied to the surface of the impact face 104 as opposed to being a filler material 126 within a recess 124. In such an embodiment, the wear shield 112 constitutes a defined zone, adjacent and on top of the surface of the impact face 104, and joined thereto.

By selectively locating the wear shield 112 adjacent to the exhaust port 110, the wear shield 112 is provided where it is most needed (though not necessarily the only place where it might be needed) and keeps material costs to a minimum.

The button inserts 122 are wear-resistant studs. It is thought that when impacting the rock formation, the reduced area of the studs 122 (compared to the drill bit body), concentrates the stress in the rock to a greater degree than the otherwise planar surface of the impact face 104.

Each button insert 122 is seated in a correspondingly shaped recess in the impact face 104. The studs 122 are secured to the body using brazing, but alternatively press-fitting, shrink fitting, gluing or any other means of attachment could be used instead.

In this embodiment, nineteen button inserts 122 are located on the drill bit body. However, any quantity of button inserts 122 could be used. Preferably, between 8 and 20 button inserts 122 are used. Of the nineteen button inserts 122, nine are located on the primary face portion 104*a* and ten are located on the secondary face portion 104*b*. The button inserts 122 may be located exclusively in the primary face portion 104*a*, exclusively in the secondary face portion 104*b* or in both.

Typically, each button insert 122 has a diameter of 12 mm to 20 mm, with a length of 10 mm to 40 mm. Other diameters may be used, for example, 6 mm to 30 mm. The diameter of the button inserts 122 used on the primary face portion 104*a* may be different to the diameter of the button inserts 122 used on the secondary face portion 104*b*.

The button inserts 122 comprise a material that may be different to the hard facing element 126. The button inserts 122 preferably comprises cemented carbide or polycrystalline diamond (PCD) material. Other wear resistant materials could be used instead.

The button inserts 122 may be spherical, hemi-spherical, ballistic, or dome shaped studs and any combination of these shapes may be used. Furthermore, the shape of the button inserts 122 located on the primary face portion 104*a* may be different to those located on the secondary face portion 104*b*.

The button inserts 122 are arranged in a non-symmetrical pattern about the axis of rotation. A proportion of the button inserts 122 are arranged in groups rotationally 'behind' each exhaust port.

The second recess 128 of the wear shield 112 extends between two of these button inserts 122. The location of the wear shield 112 with respect to the button inserts 122 is important as the wear shield 112 further prolongs the protection offered by the button inserts 122, thereby enhancing the usable life of the drill bit 100.

The wear shield 112 slows down the body wash experienced by the drill bit body 102, such that the benefits of the button inserts 122 can be realised for longer. The wear shield 112 significantly postpones the occurrence of button pop-outs. The wear shield 112 effectively bridges the difference between the comparably low wear resistance of the steel body 102 and the comparably high wear resistant button inserts 122.

The drill bit 100 further comprises a gauge protector 130 for protecting the sides of the drill bit body 102. The gauge protector 130 comprises further hard facing element 126, which tops up the otherwise reduced gauge in zone G back up to the initial full-gauge of the drill bit 100. The gauge protector 130 prolongs the full-gauge of the drill bit 100 for longer.

Additionally, or alternatively, the gauge protector 130 may comprise a recess, filled with hard facing element 126.

The drill bit 100 as described herein represents an improved value proposition and a lower cost per meter drilled, due to increased penetration rates and increased drill bit life.

While this invention has been particularly shown and described with reference to embodiments, it will be understood by those skilled in the art that various changes in form and detail may be made without departing from the scope of the invention as defined by the appended claims.

The splines 120 do not form part of the invention and an alternative way of connecting to the hammer may be used.

Similarly, the button inserts 122 are not essential, and these may be omitted.

Although the flushing medium has been described as being pressurised air, a by-product of the hammer action, the pressurised fluid to exit the exhaust ports could be a liquid instead.

The drill bit could be used for rotary drilling as well as percussive drilling, or indeed for any type of drilling which requires an exhaust port on the impact face.

Certain standard terms and concepts as used herein are briefly explained below.

As used herein, polycrystalline diamond (PCD) material comprises a plurality of diamond grains, a substantial number of which are directly inter-bonded with each other and in which the content of the diamond is at least about 80 volume per cent of the material. Interstices between the diamond grains may be substantially empty or they may be at least partly filled with a bulk filler material or they may be substantially empty. The bulk filler material may comprise sinter promotion material.

PCBN material comprises grains of cubic boron nitride (cBN) dispersed within a matrix comprising metal, semi-metal and or ceramic material. For example, PCBN material may comprise at least about 30 volume per cent cBN grains dispersed in a binder matrix material comprising a Ti-containing compound, such as titanium carbonitride and or an Al-containing compound, such as aluminium nitride, and or compounds containing metal such as Co and or W. Some versions (or "grades") of PCBN material may comprise at least about 80 volume per cent or even at least about 85 volume per cent cBN grains.

The invention claimed is:

1. A drill bit comprising:

a drill bit body with an impact face, the drill bit body having a longitudinal axis of rotation, an internal conduit for supplying pressurised fluid to the impact face, at least one exhaust port in the impact face and in fluid communication with the internal conduit, and a wear shield adjacent to each exhaust port, wherein the wear shield is located only on a trailing side of each exhaust port, defined with respect to the direction of rotation, the wear shield comprising first and second recess portions in the impact face filled with a hard facing element, the second recess portion extending from and being connected to the first recess portion, wherein the second recess portion extends substantially circumferentially away from the first recess portion.

2. The drill bit as claimed in claim 1, wherein the or each exhaust port comprises a through-hole adjoining a generally elongate flush groove in the impact face, the flush groove extending radially away from the through-hole.

3. The drill bit as claimed in claim 2, wherein the first recess portion has first and second ends, the first end being proximate the through-hole of the exhaust port, the second recess portion extending away from the first end of the first recess portion.

4. The drill bit as claimed in claim 1, wherein the first recess portion or the second recess portion is elongate and extends radially alongside each exhaust port.

5. The drill bit as claimed in claim 4, wherein the first recess portion or the second recess portion adjoins at least a flush groove of the exhaust port.

6. The drill bit as claimed in claim 1, further comprising a plurality of wear-resistant studs each seated in a correspondingly shaped recess in the impact face.

7. The drill bit as claimed in claim 6, wherein a proportion of the wear resistant studs are arranged in groups proximate to the or each wear shield.

8. The drill bit as claimed in claim 7, wherein the wear shield at least partially extends between two or more of the wear resistant studs.

9. The drill bit as claimed in claim 6, wherein the wear resistant studs comprise polycrystalline diamond (PCD).

10. The drill bit as claimed in claim 1, further comprising a gauge protector for protecting the sides of the drill bit body.

11. The drill bit as claimed in claim 10, wherein the gauge protector also comprises a hard facing element.

* * * * *